US009718179B1

(12) United States Patent
Martinez

(10) Patent No.: US 9,718,179 B1
(45) Date of Patent: Aug. 1, 2017

(54) STRIKING TOOL HAVING IMPROVED HEAD AND HANDLE ATTACHMENT

(71) Applicant: Mark R. Martinez, Merced, CA (US)

(72) Inventor: Mark R. Martinez, Merced, CA (US)

( * ) Notice: Subject to any disclaimer, the term of this patent is extended or adjusted under 35 U.S.C. 154(b) by 3 days.

(21) Appl. No.: 14/919,248

(22) Filed: Oct. 21, 2015

Related U.S. Application Data

(60) Provisional application No. 62/156,850, filed on May 4, 2015.

(51) Int. Cl.

| | |
|---|---|
| ***B25C 11/00*** | (2006.01) |
| ***B25D 1/04*** | (2006.01) |
| ***B25G 3/00*** | (2006.01) |
| ***B66F 15/00*** | (2006.01) |
| ***B25C 13/00*** | (2006.01) |
| ***B25D 1/00*** | (2006.01) |
| ***B25B 31/00*** | (2006.01) |

(52) U.S. Cl.
CPC ..... *B25D 1/04* (2013.01); *B25B 31/00* (2013.01); *B25C 13/00* (2013.01); *B25D 1/00* (2013.01); *B25G 3/00* (2013.01); *B66F 15/00* (2013.01)

(58) Field of Classification Search
USPC ..... 254/26 R
See application file for complete search history.

(56) References Cited

U.S. PATENT DOCUMENTS 1,133,277 A * 3/1915 Gore ..... B25D 1/04 81/23
1,515,089 A * 11/1924 Boyer ..... B25F 1/00 254/25
3,896,864 A * 7/1975 Green ..... B60C 29/00 81/19
4,270,587 A * 6/1981 Ludy ..... B25D 1/04 81/23
4,465,115 A * 8/1984 Palomera ..... B25D 1/06 81/24
5,002,257 A * 3/1991 Evans ..... B25C 11/00 254/26 R
5,280,738 A * 1/1994 Liou ..... B25D 1/00 81/177.8

(Continued)

FOREIGN PATENT DOCUMENTS

DE 949550 C * 9/1956 ..... B25F 1/02
TW EP 2474392 A2 * 7/2012 ..... B25G 1/01

*Primary Examiner* — Larry E Waggle, Jr.
*Assistant Examiner* — Alvin Grant
(74) *Attorney, Agent, or Firm* — Richard A. Ryan

(57) ABSTRACT

A striking tool having an improved attachment mechanism to safely and securely attach the head of the tool to the tool handle. In one configuration, the attachment mechanism has a key at the upper end of the handle that is sized and configured to be received in and engage a cooperatively configured keyway on the lower side of the head. In another configuration, the attachment mechanism has a connecting element with an elongated body that extends through a tubular body portion at an upper section of the handle and into a passageway in the head. In yet another configuration, the striking tool has both attachment mechanisms. A striking member made out of harder material can be utilized for the striking portion of the head. The connecting element can connect to an aperture in the striking member. A side nail puller can be positioned on the outer surface of the handle.

34 Claims, 13 Drawing Sheets

(56) References Cited

U.S. PATENT DOCUMENTS

| | | | | | |
|---|---|---|---|---|---|
| 5,871,204 | A * | 2/1999 | Spirer | B25C 11/00 | 254/26 R |
| 5,894,764 | A * | 4/1999 | Hanlon | B25D 1/04 | 81/23 |
| 5,988,020 | A * | 11/1999 | Johnson | B25D 1/06 | 81/23 |
| 6,301,996 | B1 * | 10/2001 | Crawford | B25D 1/06 | 81/23 |
| 6,339,974 | B1 * | 1/2002 | Kotschner | B25D 1/06 | 81/23 |
| 6,435,059 | B1 * | 8/2002 | Martinez | B25D 1/06 | 30/308.1 |
| 6,536,308 | B1 * | 3/2003 | Thorne | B25D 1/02 | 81/20 |
| 6,571,666 | B1 * | 6/2003 | Te | B25D 1/06 | 81/23 |
| 6,923,432 | B1 * | 8/2005 | Martinez | B25D 1/045 | 254/25 |
| 6,945,138 | B1 * | 9/2005 | Kreitzer | B25D 1/045 | 30/308.1 |
| 8,141,458 | B1 * | 3/2012 | Spencer | B25D 1/00 | 81/20 |
| 8,424,845 | B2 * | 4/2013 | Cole | B25D 1/045 | 254/22 |
| 9,327,394 | B2 * | 5/2016 | Chang | B25G 1/01 | |
| 2012/0186399 | A1 * | 7/2012 | Chen | B25D 1/12 | 81/22 |
| 2014/0260812 | A1 * | 9/2014 | Chang | B25D 1/12 | 81/22 |

* cited by examiner

STRIKING TOOL HAVING IMPROVED HEAD AND HANDLE ATTACHMENT

CROSS-REFERENCE TO RELATED APPLICATIONS

This patent application claims priority to U.S. Provisional Patent Application Ser. No. 62/156,850 filed May 4, 2015.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to hand-held striking tools, such as hammers and the like, that comprise a handle which is gripped by the user and a head that has at least one striking portion. More particularly, the present invention relates to such striking tools that have a head that is secured to the upper section of the handle. Even more particularly, the present invention relates to such striking tools in which the head engages the handle and/or a connecting element is received through one end of the handle to secure the head to the handle.

B. Background

Hand-held striking tools have been in use for a very long time and are available in a wide variety of different configurations which are beneficially constructed and selected to accomplish one or more striking tasks. Such tools comprise a handle having a lower end and an upper end and a head that is either attached to or integral with the handle, typically at or near the upper end thereof. A gripping portion of the handle is sized and configured to be comfortably and safely held in the hand of the user so the user can swing the handle with his or her arm to direct the head of the tool to where the work is to be accomplished. The head of the striking tool is generally structured and arranged to accomplish the desired striking or other work objective. One common configuration for a striking tool is as a hammer with the head comprising at least one striking surface that is selected to contact a work object and achieve the desired work objective, which may be to drive the work object into another object, reshape the object, break the object into smaller pieces or like tasks. Another configuration for a striking tool is as an axe having at least one blade with a sharp edge that is driven against wood to shape or break the wood. Yet another configuration for a striking tool is as a small, hand-held pick having at least one generally pointed end that is used to contact an object, such as rock, brick, concrete pad or the like, and break or chip away a portion of the object.

With regard to striking tools that are configured as a hammer, there are a wide variety of different types of hammers. Perhaps the most common type of hammer is the claw hammer, which is utilized by millions of professional and non-professional carpenters and other construction workers throughout the world. The head of the typical claw hammer has a striking portion at one end and a claw portion at the opposite end. The striking portion of the head has an outwardly disposed striking face that is directed at and makes contact with the object, such as the head of a nail or the like, for which the striking tool is being utilized to accomplish a particular work objective, such as driving the nail into a piece of wood. The striking face may be planar or have a slight curvature thereto. The claw portion of the hammer typically comprises a pair of outwardly extending, divergently spaced apart claw members that are structured and arranged to be received under the head of a nail in a manner that allows the user of the claw hammer to apply leverage to the nail to pull or pry the nail out from where it was previously placed.

Pry bars and other tools having a similarly configured claw portion are also utilized to remove nails from an object. U.S. Pat. No. 6,923,432 to Martinez (the present inventor) describes a nail puller on the side of the head of a hammer. The nail puller comprises a pair of nail engagement edges and an opening into the hammer head. The opening is designed such that the head of the nail being pulled will fit inside the opening so the nail engagement edges will engage the underside of the nail head. The user pulls the nail out of the object by laying the hammer head next to the nail head, sliding the nail engagement edges under the nail head and then rotating the hammer head to pull the nail out of the object. The opening in the hammer head is positioned at the intersection of a striking axis, which is substantially perpendicular to the striking face, and a handle axis, which is substantially parallel to the handle shaft.

Other common hammers are the sledge hammer, ball-peen hammer and rock hammer. The sledge hammer is typically configured with a much larger and heavier head than a claw hammer and it usually has a striking portion at each end of the head, with each striking portion have a striking face. The striking faces of the two striking portions are usually configured to be in opposite facing directions. Sledge hammers are most commonly utilized to drive larger, heavier objects, such as a stake, wedge, drill, chisel or the like, or to break apart harder materials, including concrete, brick and the like. The head of a typical ball-peen hammer, which is also referred to as a machinist's hammer, has a flat striking portion with a generally planar striking face and a ball striking portion with a generally hemispherically-shaped peening surface. The ball striking portion of the head is utilized to round off edges of metal pins and fasteners, such as rivets. The head of a rock hammer, which is also known as the geologist's hammer or rock pick, typically comprises a flat striking portion with a generally planar striking face and a pick portion with an outwardly extending, generally pointed pick end. The pick portion of a rock hammer is commonly utilized for splitting and breaking rocks to determine the composition of a rock and by persons in mineral and fossil collecting to get at the minerals and/or fossils.

The handle of a typical striking tool, including hammers, is sized and configured for the user to securely, safely and comfortably grip the striking tool and to maintain that grip as he or she swings the tool and contacts the head of the tool against an object. The handle of a hammer can be made out of wood, polymers and a variety of metals, including steel, aluminum, titanium and the like. As set forth above, the head of the hammer can be attached to or integral with the upper section of the handle. In one embodiment, the upper section of the handle is sized and configured to be received in an aperture in or through the head and then secured thereto using a wedge or like mechanism. In another embodiment, the handle may be made by casting or forging and joined to the head by welding or other connecting mechanism appropriate for the materials used for the handle and head. Depending on the material utilized for the handle, the lower section thereof may be coated, covered, imbedded with or otherwise comprise a gripping material that provides the user with the ability to better grip the handle, swing the tool and absorb the contact with the object being hit.

Typically, the head of a striking tool was made out of hardened steel or other very hard metals, usually by a casting or forging process, to provide a striking portion, claw portion, pick portion or other portions which are sufficiently rigid and impact resistant to allow the user provide the necessary force with the striking tool to accomplish the desired work objective. More recently, striking tool heads have also been made out of lighter weight materials, such as titanium and titanium-based alloys, that are sufficiently strong enough to accomplish the desired striking objectives but reduce the weight of the portion of the tool that is swung by the user. In addition to being easier to carry and swing, the use of a lighter weight head increases the speed of the head as it arcs through its swing path to provide a greater amount applied force at the striking face or at the other desired striking portion of the tool. An example of a lightweight striking tool that is made out of titanium or a titanium-based alloy is set forth in U.S. Pat. No. 6,435,059 to Martinez (the present inventor). Compared to hardened steels and the like, titanium is a softer material. As a result, the impact force against the striking portion of the head can result in wear and distortion, particularly at or near the striking face. To reduce the likelihood of wear and distortion, U.S. Pat. No. 6,536,308 to Thorne, et al. describes the addition of a separate, steel hardened striking member on the head of the striking tool to provide the desired striking face or working surface. In one embodiment, the hardened steel striking member has a cylindrical projection that is sized and configured to be shrink fit into a cylindrical recess in the head of a hammer, with the head being made out of the lighter weight titanium or titanium-based alloy.

Despite the various advantages of the prior art with regard to improved configurations for striking tools, including those set forth above, there remains a need for further improvements to striking tools. Specifically, with regard to the head of the striking tool, there is a need to be able to separately replace either the head or the handle of the striking tool. As well known by persons skilled in the art, often either the head or the handle of the striking tool will prematurely wear or become damaged so it is no longer useable, such as the striking portion becoming misshaped or the handle breaking, while the other portion of the tool is still useable. Presently, because it is usually too difficult or not cost effective to replace only the head or the handle of a striking tool, it is common that the entire striking tool is replaced.

What is needed, therefore, is a striking tool that has an improved mechanism for connecting the head and handle together. In one configuration, the improved striking tool should join the head and the handle together in a way which makes replacement of one of these components much easier and less expensive than with current striking tools. The mechanism for joining the head and handle of the improved striking tool should safely and effectively secure the head to the handle so these components will not become disengaged during use. Preferably, such an improved striking tool will be able to be configured as a wide variety of different types of tools, including hammers, axes and the like, so the benefits thereof can be utilized with such tools. The improved striking tool should be also adaptable for utilizing an improved configuration of a nail puller that can be utilized to help pull nails out of an object and for use with an improved striking member that reduces the likelihood of damage to the striking portion of a head that is made out of lighter weight materials, such as titanium and titanium-based alloys.

SUMMARY OF THE INVENTION

The striking tool of the present invention solves the problems and provides the benefits identified above. That is to say, the present invention discloses a new striking tool having an improved mechanism for connecting the head and handle of the tool together. The mechanism which joins the head and handle together of the improved striking tool is structured and arranged such that it safely and effectively secures the head to the handle so head will not become disengaged from the handle during use of the striking tool. In one embodiment, the improved striking tool allows the user to separate the head from the handle of the tool so that he or she may replace either the head or the handle as necessary or desired. In one configuration, the handle has an aperture at the upper end thereof that is positioned perpendicular to the handle axis that receives a pin, bolt or other connector that engages the head to secure the head to the handle. In another configuration, the striking tool also or alternatively utilizes a cooperatively configured key and keyway structure to join the head and handle together. The improved striking tool of the present invention is able to be configured as a wide variety of different types of striking tools, including hammers, axes and the like. For use with heads that are made out of titanium, titanium-based alloys and other relatively softer metals, a separate striking member can be connected to the head of the striking tool of the present invention to reduce the likelihood of impact damage to the striking portion of the head. An improved nail puller can also be utilized with the improved striking tool of the present invention to allow use of the striking tool pull nails out of an object. Other secondary work objects, such as specially configured wrenches and the like, can also be attached to the striking tool of the present invention.

In one general aspect of the present invention, the new striking tool comprises an elongated handle, a head and an attachment mechanism safely and securely connecting the head and the handle. The handle has an upper end and a lower end, with an upper section disposed toward the upper end and a lower section disposed toward the lower end. The head has a striking portion that is used to accomplish the desired work objective. In one configuration, the striking portion comprises a generally flat or planar striking surface. The attachment mechanism can comprise a key at an upper end of the handle that is slidably or otherwise received in a slotted keyway on a lower side of the head or a connecting element that is disposed in a passageway which is transversely disposed through a tubular body portion at the upper portion of the handle so as to be received in a passageway of the body portion of the head. In one embodiment, the striking tool comprises both of these attachment mechanisms.

For the key/keyway configuration, the key has a first side and a second side and the keyway has a slot defining a first engagement side and a second engagement side. To provide the desired engagement of the key in the keyway, the first engagement side of the keyway is cooperatively configured with the first side of the key and the second engagement side of the keyway is cooperatively configured with the second side of the key. The tool head has an engagement face that is cooperatively positioned with the keyway so as to abut a first end of the key when the key is disposed in the keyway and the head is connected to the handle. Various devices and processes, including a shrink fit process, can be utilized to secure the key in the keyway and, as a result, attach the head to the handle.

For the connecting element configuration, the connecting element has an elongated body that is sized and configured to extend through the tubular body portion of the handle and engage an aperture in a body portion of the head. More specifically, the elongated body of the connecting element has a first end and a second end, the tubular body portion has a first end and a second end and the aperture is disposed in an engaging face of the body portion of the head. The first end of the connecting element is sized and configured to pass through the passageway and engage the aperture in the body portion of the head to place the first end of the tubular body in abutting relationship with the engaging face of the body portion to secure the head to the handle. In one configuration, the connecting element has a cap at the second end of the elongated body, with the cap being sized and configured to engage the second end of the tubular body portion when the connecting element is fully received in the passageway with the first end of the connecting element received in the aperture of the body portion. Various devices and processes, including a shrink fit process, can be utilized to secure the connecting element in the passageway through the handle and the aperture to the head to attach the head to the handle.

In a second embodiment of the present invention, the striking tool comprises one or both of the attachment mechanisms described above and a striking member that is secured to the striking portion of the head. In one embodiment, the striking member provides a generally flat or planar striking surface for the head. The striking member is particularly useful when the head is made out of titanium or titanium-based alloy, or other relatively soft materials, with the striking member being harder than the titanium or titanium alloy of the head. For the configuration where the attachment mechanism comprises the connecting element, the striking member has an aperture that is sized and configured to receive and engage the distal or first end of the connecting element. In use, the connecting element extends through the passageway of the tubular body portion of the handle and through the body portion of the head to be received in and engage the aperture of the striking member to secure the head to the handle and the striking member to the head.

In a third embodiment of the present invention, the striking tool also comprises a side nail puller that is attached to or integral with the upper section of the handle. The side nail puller comprises a body that is shaped and configured and in spaced apart relation to an outer surface of the handle to define a chamber with the outer surface of the handle. The body has a pair of nail engaging edges that define a v-shaped opening opposite the outer surface of the handle, with the v-shaped opening being sized and configured to receive a nail with the nail head in the chamber of the side nail puller to facilitate pulling the nail out of an object, such as a piece of wood. The v-shaped opening of the nail puller has an apex that is positioned substantially along the longitudinal axis of the handle.

Accordingly, the primary objective of the present invention is to provide an improved striking tool that provides the advantages discussed above and overcomes the disadvantages and limitations associated with presently available striking tools.

It is also an important object of the present invention to provide a new striking tool that utilizes an improved mechanism for connecting the head of the striking tool to the handle, which in one embodiment will allow the user to remove the head from the handle to replace either the head or the handle.

Another important object of the present invention is to provide a new striking tool that has a hardened striking member and/or a side nail puller.

An important aspect of the present invention is that it provides an improved mechanism for attaching the head of a striking tool to the handle of the tool that effectively and safely secures the head to the handle.

Another important aspect of the present invention is that it provides an improved striking tool which, in one embodiment, allows the user to separate the head from the handle of the tool so that he or she may replace either the head or the handle as necessary or desired.

Another important aspect of the present invention is that it provides an improved striking tool that is able to be configured as a wide variety of different types of striking tools, including hammers, axes and the like.

Another important aspect of the striking tool of the present invention is that is adaptable for utilizing a separate, steel-hardened striking member that is connected to the head of the striking tool when the head is made out of titanium, titanium-based alloys or other relatively soft metals to reduce the likelihood of impact damage to the striking portion of the head.

Yet another important aspect of the striking tool of the present invention is that it can include an improved nail puller and/or other secondary work objects on the side of the striking tool to increase the functionality of the striking tool.

As will be explained in greater detail by reference to the attached figures and the description of the preferred embodiment which follows, the above and other aspects are provided or accomplished by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more of the preferred embodiments and, as such, only represent several possible ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the illustrations and description provided herein are generally directed to certain types of striking tools, namely a claw hammer and a ball-peen hammer, and to certain configurations and materials for those tools, persons who are skilled in the relevant art will readily understand that such illustrations are merely for purposes of simplifying the present disclosure and that the present invention is not so limited. As will be further appreciated by persons skilled in the art, the new and improved features of the striking tool of the present invention can be incorporated into a wide variety of different striking tools and can be made in different tool configurations and out of a wide range of materials.

Figure 2:
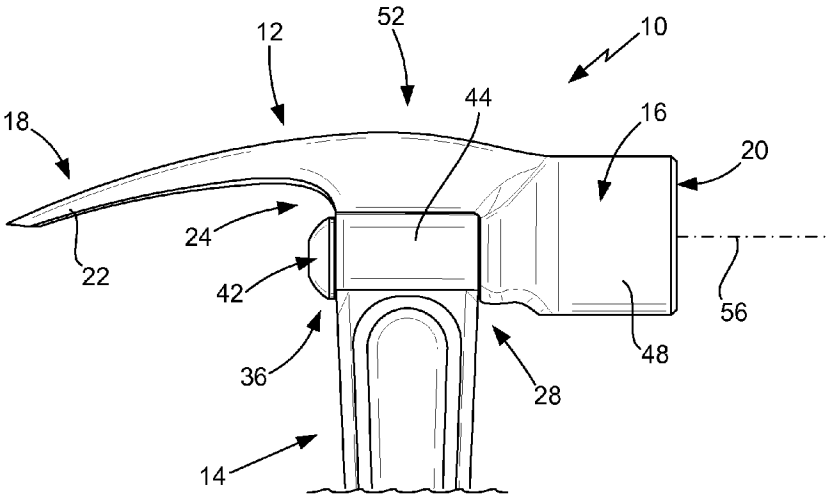
FIG. 2 is an enlarged isolated side view of the upper end of the striking tool of FIG. 1.
Figure 1:
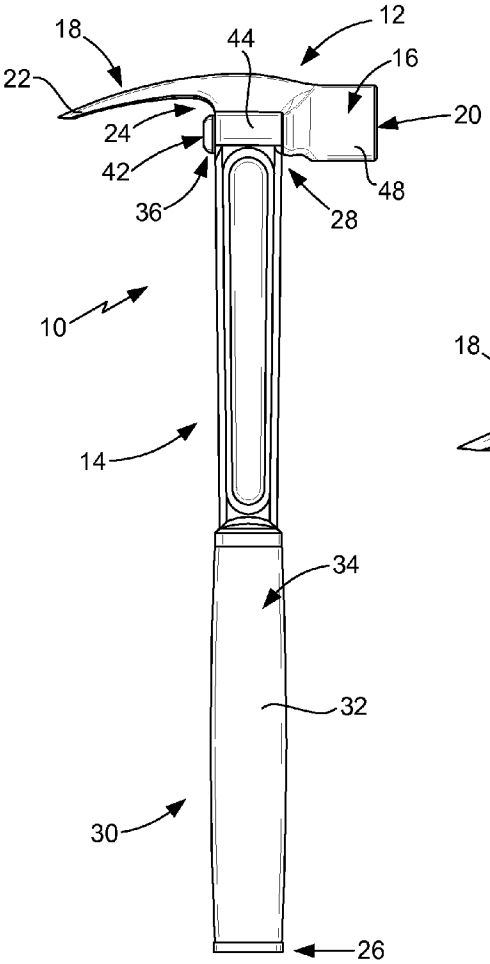
FIG. 1 is a side view of a striking tool configured according to a first embodiment of the present invention, with the striking tool configured as a claw hammer having a covered handle.
Figure 5:
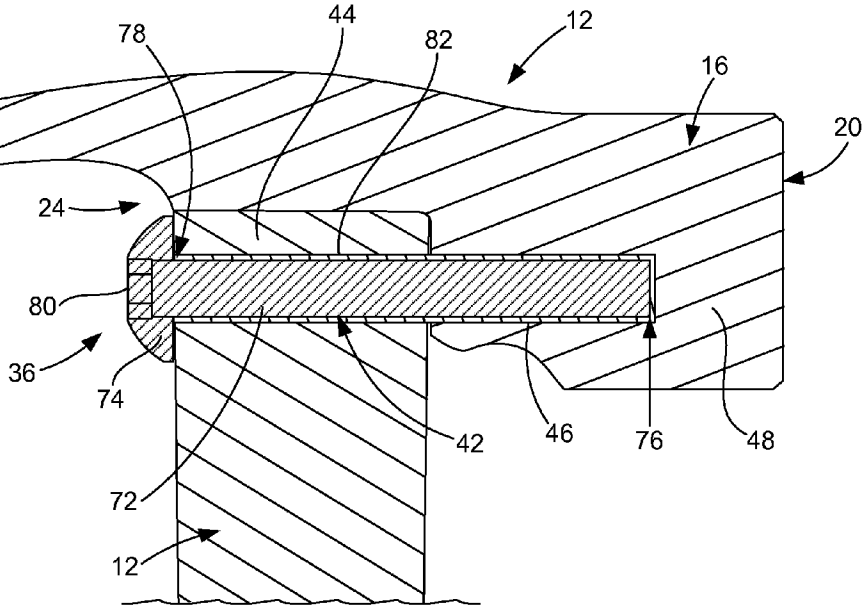
FIG. 5 is a cross-sectional side view of the striking tool of FIG. 2 taken through lines 5-5 of FIG. 4.
Figure 4:
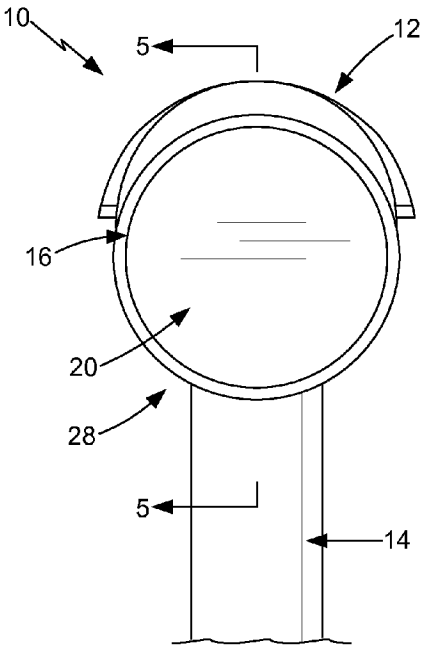
FIG. 4 is an end view of the striking portion of the striking tool of FIG. 3 particularly showing the striking face thereof.
Figure 6:
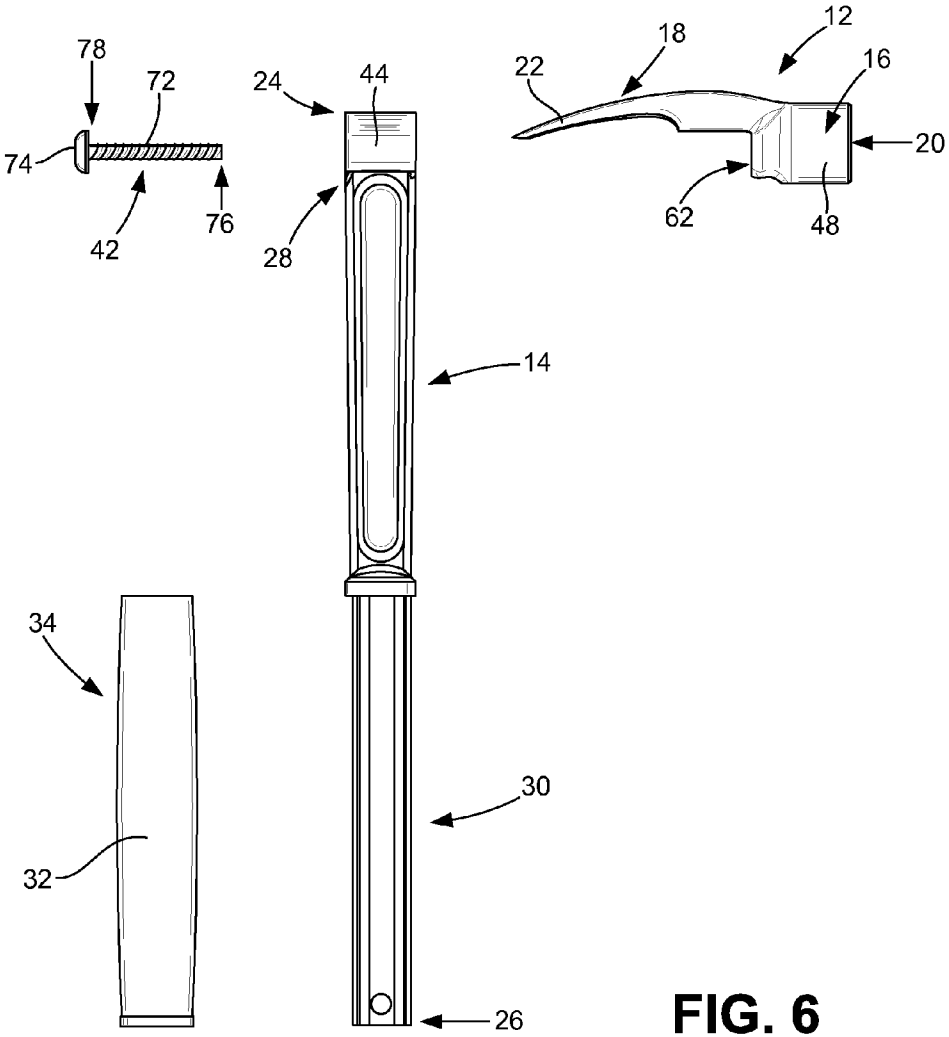
FIG. 6 is an exploded side view of the striking tool of FIG. 1.

An improved striking tool that comprises the components and which is configured pursuant to various embodiments of the present invention is shown generally as 10 in the figures. As best shown in FIG. 1, the striking tool 10 of the present invention comprises a head 12 and an elongated handle 14. As will be readily familiar to those skilled in the art, the striking tool 10 shown in FIGS. 1-6 is configured as a claw hammer with the head 12 having a striking portion 16 and a claw portion 18. The striking portion 16 has an outwardly disposed striking face 20 that is shaped and configured to strike against an object, such as the head of a nail or the like. The claw portion 18 of the striking tool 10 has a pair of divergently spaced apart claw members 22 that are shaped and configured to allow the user of the striking tool 10 to pull a nail out of a piece of wood or other item. As best shown in FIGS. 1 and 6, the handle 14 of the striking tool 10 has an upper end 24 and a lower end 26, with an upper section 28 of the handle 14 generally toward the upper end 24 thereof and a lower section 30 of the handle 14 generally toward the lower end 26 thereof. As will be readily appreciated by persons skilled in the art, the configuration of the striking tool 10 of the present invention will be generally the same for other striking tools with regard to having a head 12, handle 14 and a striking portion 16, although the striking portion 16 may be configured significantly different than for the claw hammer of FIGS. 1-6. Except for the claw portion 18, most standard hammers are configured generally the same as the claw hammer in that they will also have at least one striking portion 16 with a striking face 20 that is utilized for various striking tasks, including breaking concrete, bricks, rocks and the like. Other striking tools 10 may be configured as an axe wherein the striking portion 16 of the head 12 has a sharp blade or as a pick where the striking portion 16 of the head 12 has a pointed end. As will be readily apparent to persons familiar with striking tools generally, the various features and advantages of the striking tool 10 of the present invention can be incorporated into a wide variety of different types of striking tools.

The head 12 and handle 14 of the striking tool 10 of the present invention can be made out of wide variety of different materials, with the head 12 and handle 14 either being the same material or being different materials. In one embodiment, the head 12 is made out of hardened steel, as is common for many hammers, axes, picks and other striking tools, and formed by a casting or forging process. In another embodiment, the head 12 is made out of titanium, a titanium-based alloy or other relatively lighter weight materials (i.e., lower density than hardened steel). As described in the prior art, particularly with regard to U.S. Pat. No. 6,435,059 to Martinez and U.S. Pat. No. 6,536,308 to Thorne, et al., the disclosure of these two patents are incorporated herein as though full set forth in the present disclosure, the use of lighter weight materials such as titanium and titanium-based alloys has certain advantages with regard to swing movement and applied force and certain disadvantages with regard to wear, distortion and the generation of sparks when struck against certain surfaces. Despite any of the disadvantages, however, the use of titanium, titanium-based alloys and/or other lighter weight materials for head 12 is very popular.

The handle 14 of striking tool 10, including claw hammers and the like, can be made out of wood, polymers and a variety of metals, including hardened steel, aluminum, titanium and the like. The lower section 30 of the handle 14 is beneficially sized and configured for the user to securely, safely and comfortably grip the striking tool 10 and to maintain that grip as he or she swings the tool 10 and contacts the striking portion 16 of the head 12 against an object. Depending on the material utilized for the handle 14, the lower section 30 thereof may be coated, covered, imbedded with or otherwise comprise a gripping material 32, as shown in FIGS. 1 and 6, that allows the user to better grip the handle 14 when he or she swings the tool 10 and which will also absorb some of the contact force that results from the object being hit. In one embodiment, the gripping material 32 is a rubber sleeve 34 that is formed around the lower section 30 of the handle 14. A wide variety of other materials can be utilized for the gripping material 32.

For the striking tool 10 to function for its intended purpose, the head 12 must be safely and securely attached to the handle 14. Prior art striking tools generally either are made with the head 12 and the handle 14 being integrally formed or fixedly attached by welding or the like or they provide an aperture (also referred to as an eye) that is vertically disposed (i.e., aligned with the longitudinal axis of the handle) through the head that is sized and configured for the upper end of the handle to pass through the aperture to position the head at the upper section of the handle. Various devices are used to then secure the upper end of the handle inside the aperture through the head. The striking tool 10 of the present invention provides an improved attachment mechanism, shown generally as 36 in FIGS. 1-5, 12 and 14-15, for safely and securely attaching the head 12 of the striking tool 10 to the handle 14 thereof.

In the embodiment of the striking tool 10 shown in FIGS. 1-5, the attachment mechanism 36 comprises a combination of: (1) a slotted keyway 38 in the head 12 that receives a key 40 which is positioned at the upper end 24 of the handle 14; and (2) a connecting element 42 that is received through a tubular body portion 44 of the handle 14 and into a passageway 46 in the body portion 48 of the head 12, as shown in FIGS. 1-11. As will be readily appreciated by persons skilled in the art, the use of the attachment mechanisms 36 identified above and described in more detail below allows for a wide variety of different types of heads 12 and handles 14, and materials for the head 12 and handle 14, that can be connected together as may be desired by the manufacturer and/or purchasers of striking tool 10.

Figure 3:
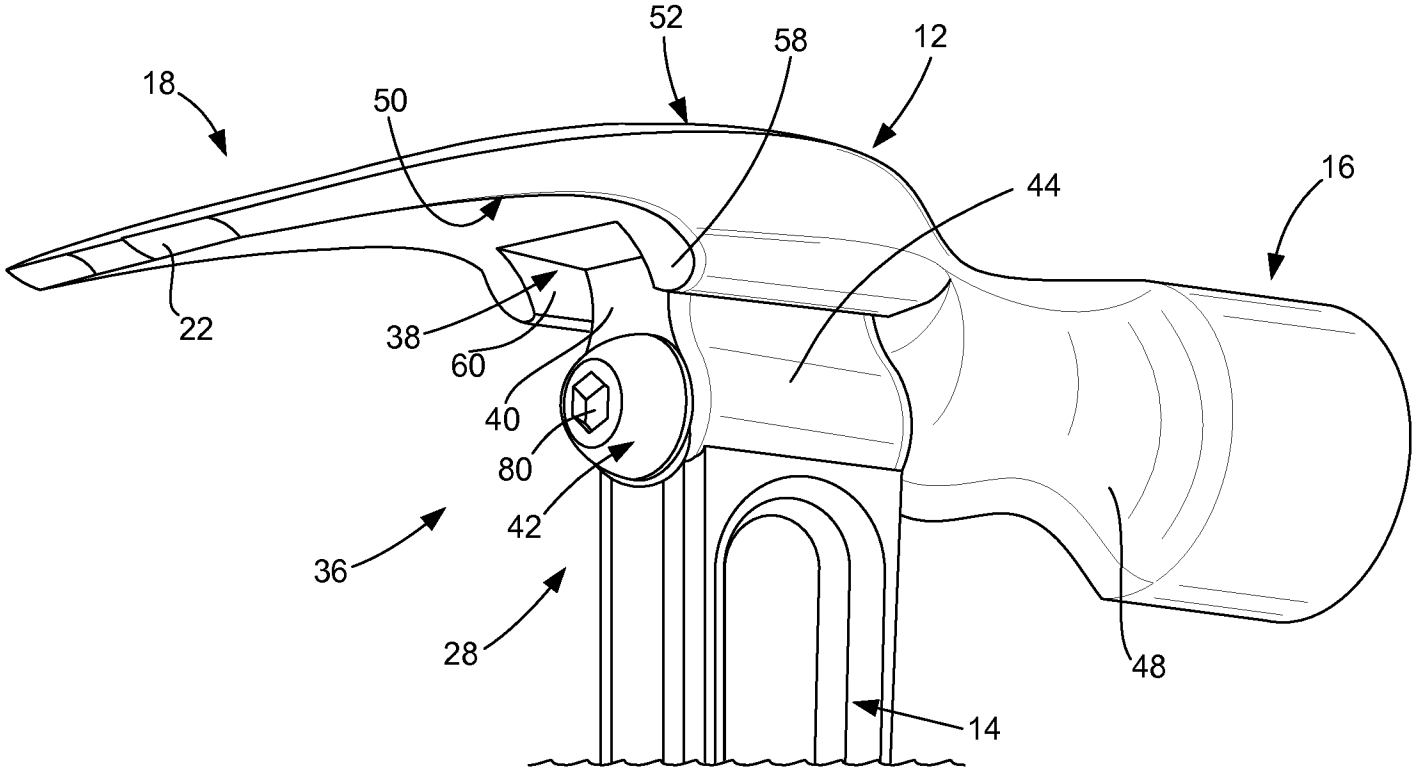
FIG. 3 is a side perspective view of upper end of the striking tool of FIG. 2.
Figure 8:
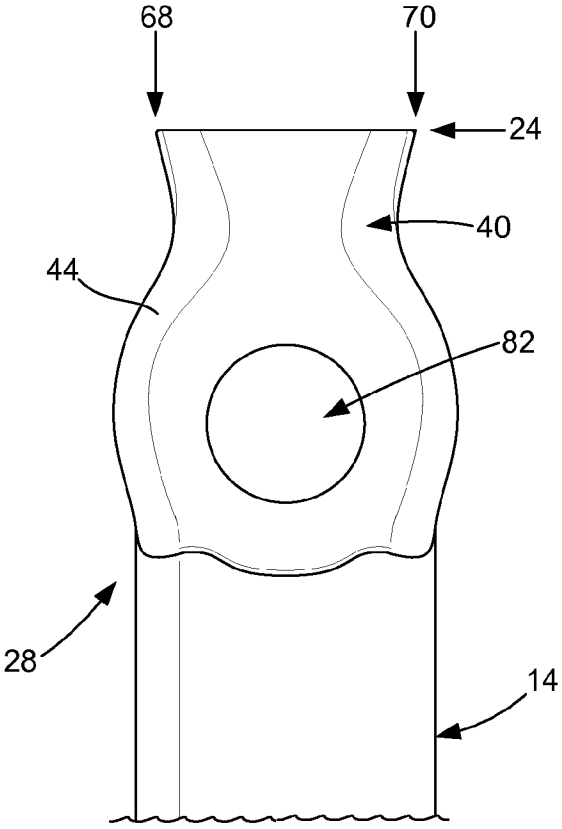
FIG. 8 is an end view of the upper section of the handle of FIG. 7.
Figure 7:
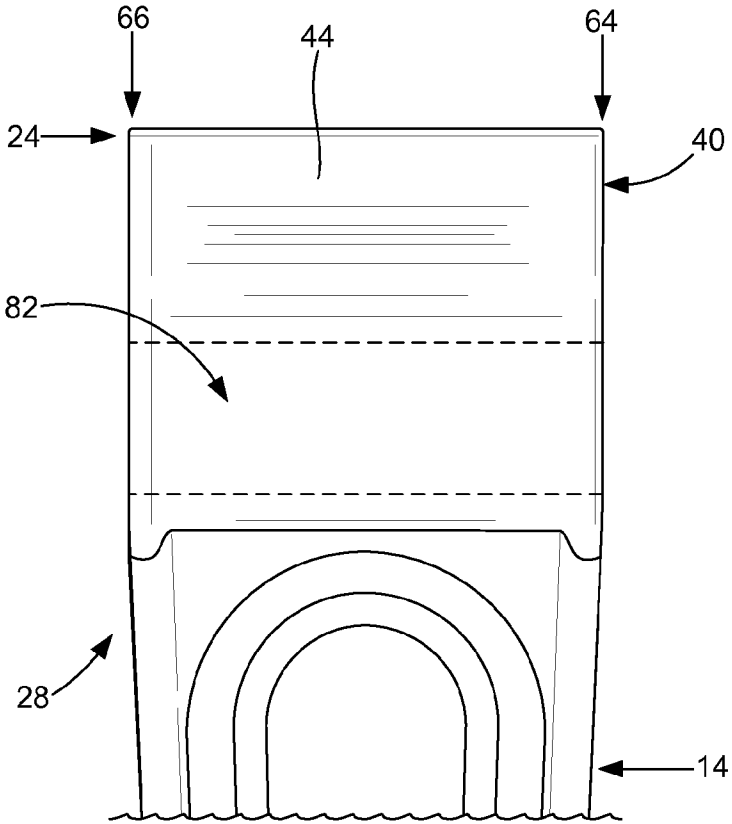
FIG. 7 is a side view of the upper section of the handle of FIG. 6.
Figure 9:
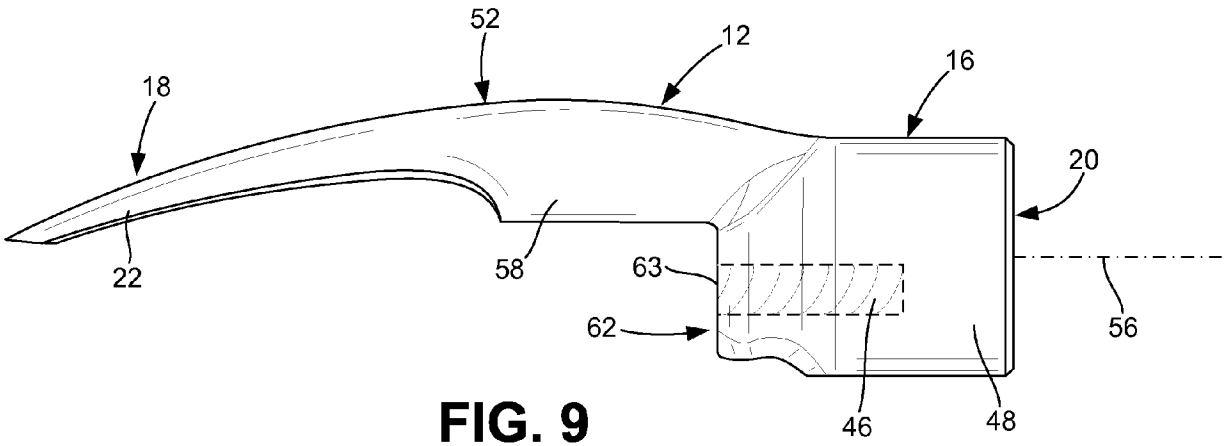
FIG. 9 is a side view of the hammer head of FIG. 6.
Figure 10:
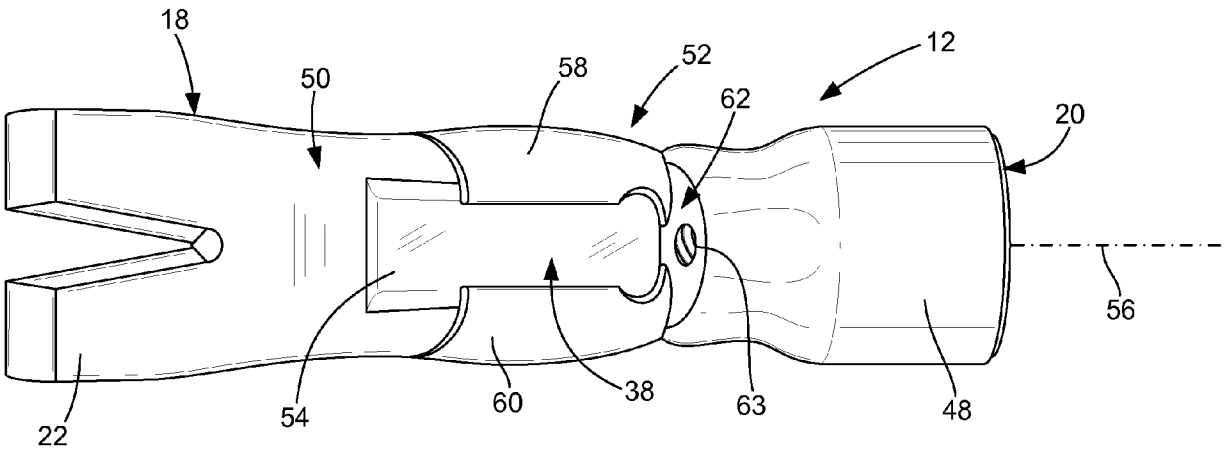
FIG. 10 is a bottom view of the hammer head of FIG. 9.
Figure 11:
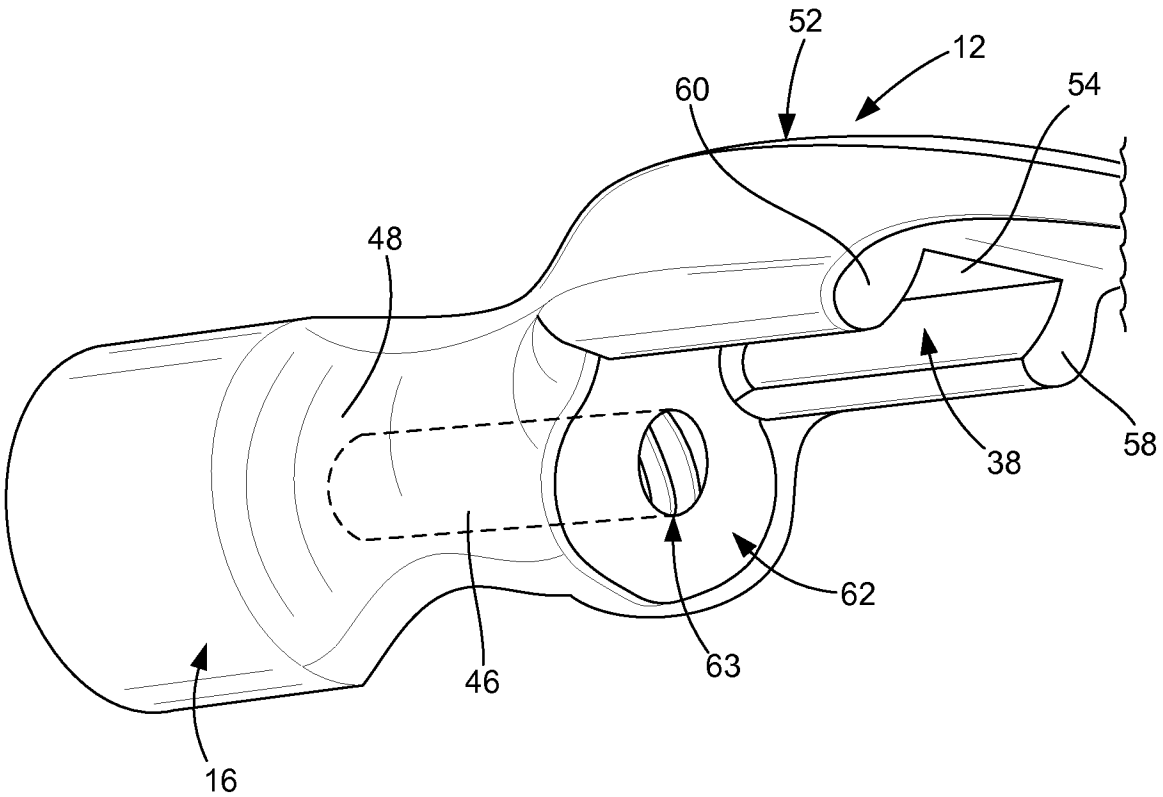
FIG. 11 is an end perspective view of the claw portion of the hammer head of FIG. 9 shown with part of the claw member not shown to better illustrate the keyway and the aperture in the body portion of the head.

As best shown in FIGS. 3, 10 and 11, the slotted keyway 38 is formed into the bottom side 50 of the center portion 52, which is between the striking portion 16 and claw portion 18, of the head 12. As best shown in FIGS. 3, 7 and 8, the key 40 is positioned at the upper end 24 of the handle 14. In one embodiment, the keyway 38 and key 40 are cooperatively configured so the key 40 will slide into and engage the keyway 38 to secure the head 12 to the handle 14 and, thereby, form striking tool 10. In another embodiment, the key 20 is inserted into the keyway 38. The keyway 38 is defined by a slot 54 in the center portion 52 of the head 12 that is generally parallel to the striking axis 56 of the striking face 20, as best shown in FIG. 10, and a pair of engagement sides, namely first engagement side 58 and second engagement side 60 which are on opposite sides of the slot 54. One end of the slot 54 of keyway 38, namely the end of the slot 54 toward the striking face 20, is closed by engagement face 62 at the rearward end of the striking portion 16, as best shown in FIGS. 9-11. In the embodiments shown in the figures, the opposite end is open. As set forth below, this opposite end can also be closed. An aperture 63 in the engagement face 62 defines the opening into the passageway 46 in the body 48 of the head 12, with aperture 63 and passageway 46 being cooperatively sized and configured with connecting element 42 to receive the connecting element 42 (i.e., threadably) to connect the head 12 to the handle 14.

In one embodiment, the key 40 is integrally formed with or attached to the upper end 24 of the handle 14. In the embodiment shown in the figures, with both attachment mechanisms 36, the key 40 is integrally formed with the tubular body portion 44 and extends from the first end 64 of the tubular body portion 44 to the second end 66 thereof, as best shown in FIG. 7. The first side 68 and second side 70 of the key 40 are shaped and configured in corresponding relation with the first engagement side 58 and the second engagement side 60 of the keyway 38. In the embodiment of FIGS. 1-11, the keyway 38 has a wider upper end than the lower end (best shown in FIG. 11) and the engaging portion of the key 40 also has a wider upper end than lower end so the key 40 will slide into the keyway 38 but resist being pulled out of the keyway 38 by a downward force (from the view of the figures) to prevent the head 12 from disengaging from the handle 14 during use of the striking tool 10. Preferably, the sides 68/70 of the key 40 frictionally engage, respectively, the inner surfaces of the first 58 and second 60 engagement sides and the key 40 should be able to slide into the keyway 38 until the first end 64 of the key 40 is in abutting relation with the engagement face 62 at the end of the slot 54.

In one embodiment, the head 12 can securely attach to the handle 14 by configuring the keyway 38 and key 40 so as to be closely dimensioned such that the key 40 tightly fits into the keyway 38. To ensure that the key 40 stays in engagement with the keyway 38, various attachment processes, devices and mechanisms can be utilized. For instance, depending on the respective materials for the head 12 and handle 14, the use of various adhesives may be sufficient to secure the key 40 in the keyway 38. With the key 40 fully in the slot 54 of keyway 38, such that the first end 64 of key 40 is abutting the engagement face 62 at the striking portion 16 of the head 12, a screw or other device or a spot weld can be placed at the location where the second end 66 of the key 40 is at the slot 54 (as best shown in FIG. 3) to secure the key 40 in the keyway 38. In another embodiment, the head 12 and handle 14 could be treated in a manner that secures the key 40 in the keyway 38. For instance, the key 40 can connect to the keyway 38 using a "shrink fit" process whereby the key 40 is dimensioned to be slightly larger than the keyway 38 and the head 12 is heated enough that the keyway 38 thereof will expand a sufficient amount to allow the otherwise slightly larger key 40 to fit within the keyway 38. Upon cooling, the keyway 38 will shrink around the key 40 and secure the head 12 to the handle 14. The use of shrink fit processes to join to components together is generally well known in the art and is utilized for certain prior art striking tools.

Figure 22:
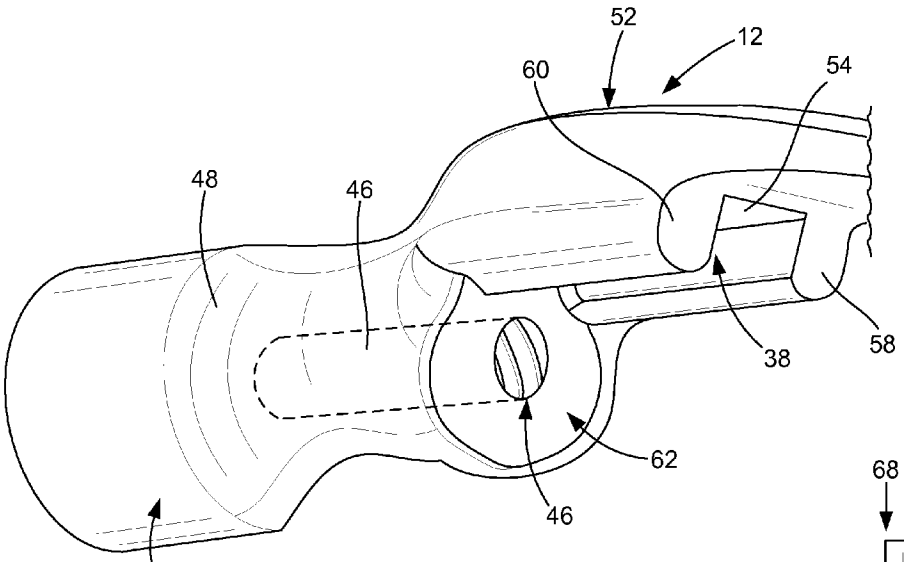
FIG. 22 is an end perspective view of a hammer head of a striking tool configured according to a fifth embodiment of the present invention, with the keyway being generally rectangular shaped.
Figure 23:
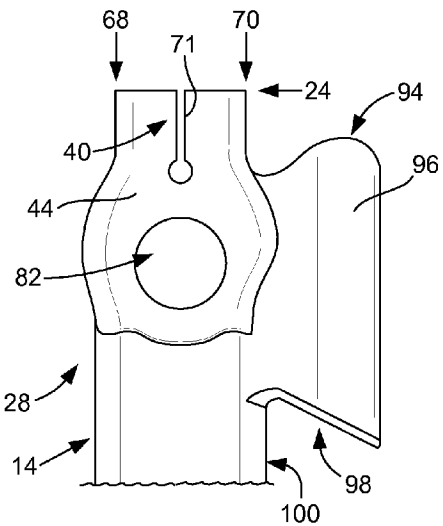
FIG. 23 is an end view of the upper section of a handle configured for use with the hammer head of FIG. 22 showing the key thereof being rectangular shaped so as to be in corresponding relation to the keyway of FIG. 22 and the key having a slot therein for secure engagement of the key in the slot.

In the embodiment of FIGS. 22 and 23, the keyway 38 and key 40 are rectangular shaped so the key 40 will slide or otherwise be positioned into the keyway 38. To securely engage the key 40 of the handle 12 in the keyway 38 of the head 12, the key 40 has a slot 71 that extends downward into the key 40 from the upper end 24 of the handle 14 toward, but generally not to, the passageway 82 of the handle 14, as shown in FIG. 23. The slot 71 extends from the first end 64 to the second end 66 of the key 40. With the slot 71 in the key 40, the width of the key (i.e., between first side 68 to second side 70) will be made to be slightly larger than the width of the slot 54 of keyway 38 between the first engagement side 58 and second engagement side 60. When the key 40 is inserted into the keyway 38, typically after heating one or both of the keyway 38 and key 40, the slot 71 in the key 40 will allow the two sections of the key 40 to move towards each other a sufficient amount for the key 40 to fit into the slot 54 of the keyway 38. Upon cooling, the key 40 will expand to tightly engage the inner surfaces of the slot 54 between the first 58 and second 60 engagement sides of the keyway 38 so as to safely secure the head 12 to handle 14. Although the embodiment of FIG. 22 shows the end of the slot 54 toward the claw portion 18 (i.e., opposite of the engagement face 62) as open to allow the key 40 to slide into the slot 54, this end can be closed (i.e., a solid wall) such that the key 40 is directed into the slot 54 from below the center portion 52 of the head 12.

Figure 12:
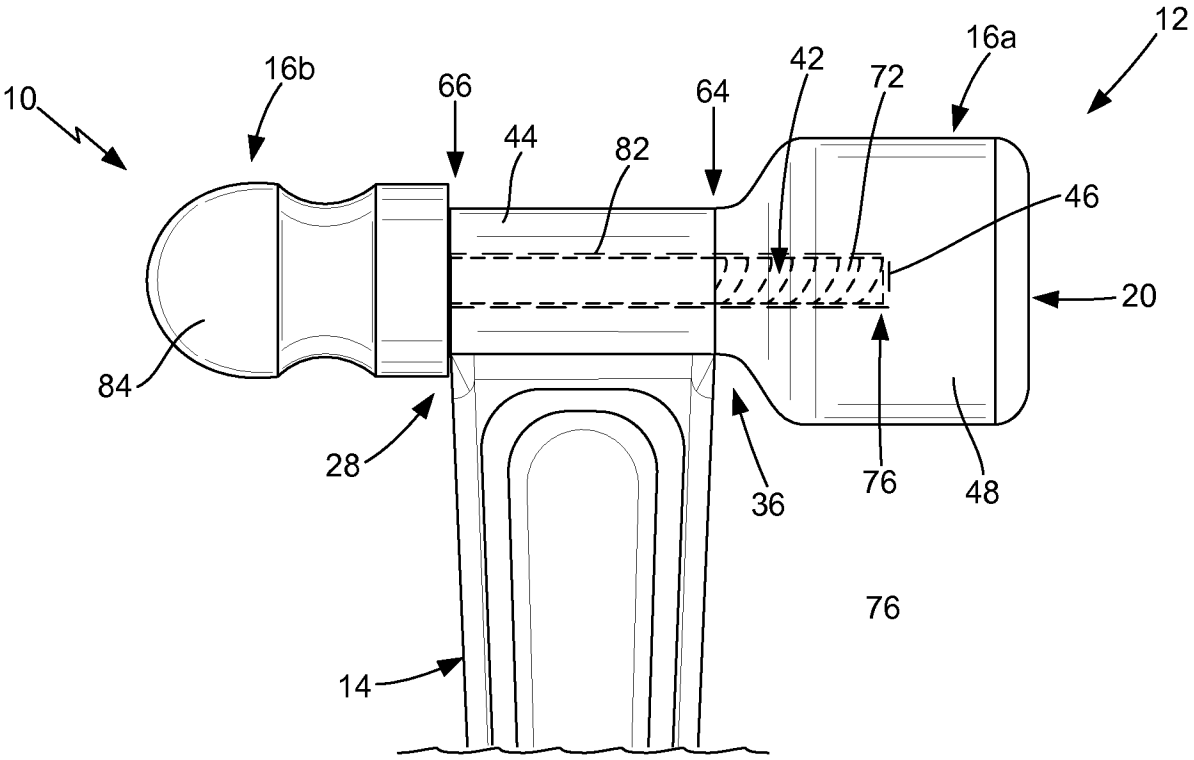
FIG. 12 is a side view of a striking tool configured according to a second embodiment of the present invention, with the striking tool configured as a ball-peen hammer.

In one embodiment of the striking tool 10 of the present invention, the head 12 is joined to the handle 14 using only the keyway 38 and key 40 connection described above. In other embodiments, including the embodiments of FIGS. 1-11 and 22-23, the attachment mechanism 36 of the striking tool 10 utilizes both the keyway 38/key 40 components and the connecting element 42 and passageway 46 in the body portion 48 of the head 12 to secure the head 12 to the handle 14, as best shown in FIGS. 1-3 and 5-6. The connecting element 42 shown in the figures comprises an elongated body 72 having a cap 74 at the first end 76 thereof and being of sufficient length that the second end 78 will extend through the tubular body portion 44 of the handle 14, through the aperture 63 and sufficiently into the passageway 46 in the body portion 48 of the head 12, as best shown in FIGS. 5 and 12, to secure the head 12 to the handle 14. As shown in FIG. 3, when the connecting element 42 is properly secured to the head 12, the cap 74 will be in abutting relation to the second end 66 of the tubular body portion 44. The cap 74 can be slotted or have a receptacle 80 therein, as shown in FIGS. 3 and 5, that facilitate handling of the connecting element 42. The connecting element 42 is sized and configured to fit through a passageway 82, best shown in FIGS. 7 and 8, transversely disposed through the tubular body portion 44 of the handle 14, namely from the second end 66 to the first end 64 of tubular body portion 44. The connecting element 42 must also be dimensioned to fit through the aperture 63 and into the passageway 46 in the body portion 48 of the head 12, with the aperture 64 in the engagement face 62 best shown in FIGS. 10 and 11. In a preferred configuration, the length of the elongated body 72 of the connecting element 42 is sufficient for the first end 76 thereof to at least generally extend to the end of the passageway 46 in the body portion 48 of the head 12, as shown in FIGS. 5 and 12.

In one embodiment, the elongated body 72 of the connecting element 42 is threaded, the passageway 46 in the body portion 48 of the head 12 is correspondingly threaded and the receptacle 80 in the cap 74 is configured to facilitate connecting element 42 being received (threadably or slidably) through the passageway 82 and into the passageway 46 to secure the head 12 to the handle 14. With the above embodiment, the head 12 can be removably attached to the handle 14. In another embodiment, the connecting element 42 is a pin having a relatively smooth elongated body 72 that is dimensioned to be slightly larger than the passageway 82 and the passageway 46. Using a shrink fit process, the head 12 and at least the upper section 28 of the handle 14, having the tubular body portion 44, are heated so the passageway 82 through the handle 14 and the passageway 46 in the head 12 will expand a sufficient amount to allow the otherwise slightly larger elongated body 72 of the connecting element 42 to fit within the passageway 82 and passageway 46. Upon cooling, the passageway 82 through the tubular body portion 44 and the passageway 46 in the body portion 48 of the head 12 will shrink tightly around the elongated body 72 of the connecting element to secure the head 12 to the handle 14. In this manner of connecting the head 12 to the handle 14, it may not be necessary for the connecting element 42 to have cap 74 (i.e., the connecting element 42 only comprises the elongated body 72). If desired, various adhesives or other connecting mechanisms can be utilized in addition to or instead of the previously described threading or shrink fit processes.

Figure 13:
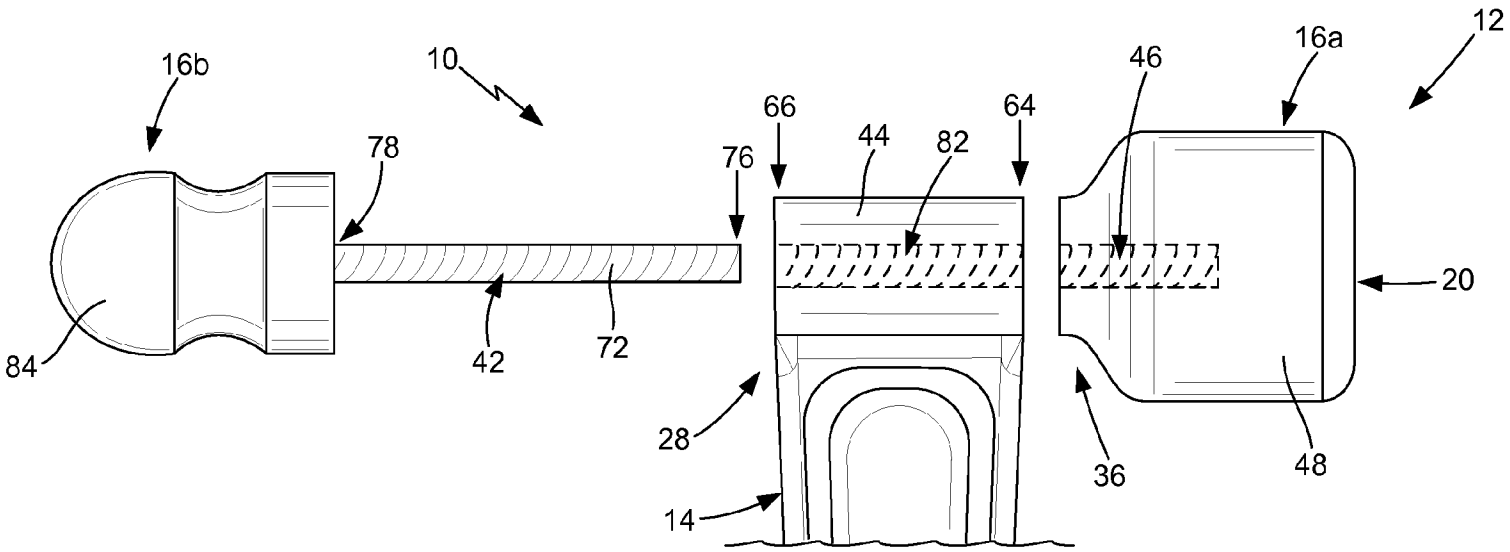
FIG. 13 is an exploded side view of the striking tool of FIG. 12.

In another embodiment of the striking tool of the present invention, the attachment mechanism 36 can comprise only the connecting element 42, tubular body portion 44 of the handle 14 and passageway 46 in the head 12, meaning no slotted keyway 38 or key 40. An example of such a configuration is shown with regard to the striking tool 10 being a ball-peen hammer in FIGS. 12-13. In this embodiment, the striking tool 10 has two striking portions, namely a first striking portion **16*a* having a generally flat or planar striking face 20 and a second striking portion 16*b* having a generally hemispherically-shaped peening surface 84. As best shown in FIG. 13, the connecting element 42 of this embodiment is attached to and extends outwardly from the second striking portion 16*b* to engage the passageway 46 in the first striking portion 16*a*. Instead of the peening surface 84, the striking tool 10 can have various other striking items, such as a pick for a rock hammer or the like, or non-striking items. If desired, the striking portion 16 can be joined to the tubular body portion 44 of the handle 14 without any other items on the opposite side of the handle 14. As described above, the connecting element 42 can threadably engage the striking portion 16 or various adhesives or shrink fit processes, as well as other devices or processes, can be utilized to secure the head 12 to the handle 14**.

Figure 15:
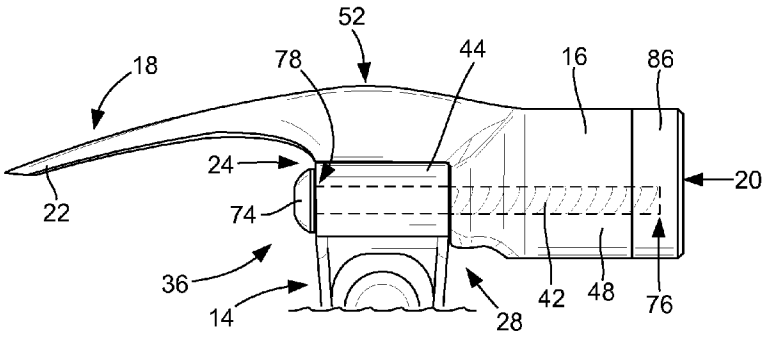
FIG. 15 is an enlarged end view of the upper section of the striking tool of FIG. 14.
Figure 16:
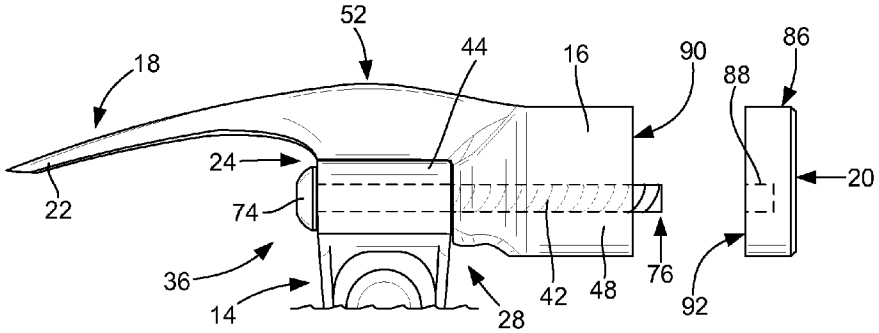
FIG. 16 is a side view of the striking tool of FIG. 14 showing the striking member thereof separate from the tool head.
Figure 17:
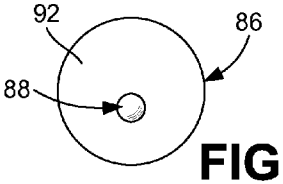
FIG. 17 is an end view of the striking member of FIG. 16 showing the connecting aperture thereof.
Figure 14:
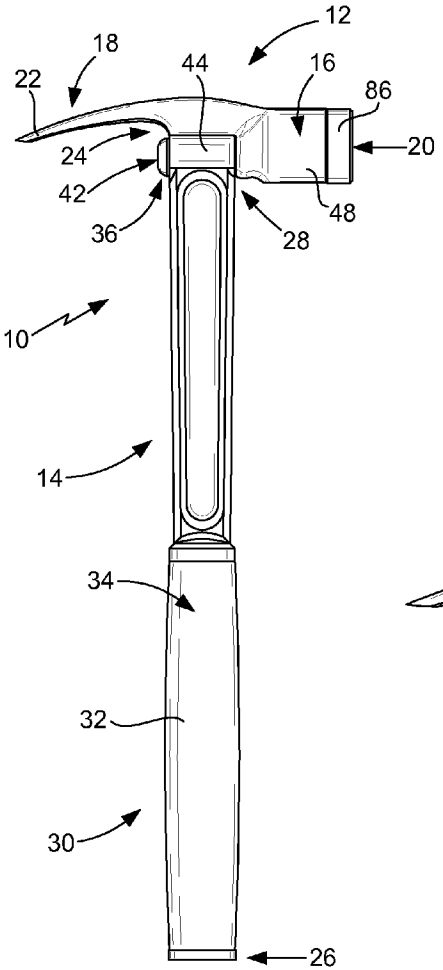
FIG. 14 is a side view of a striking tool configured according to a third embodiment of the present invention, with the striking tool shown utilizing a striking member on the head.

FIGS. 14-18 show use of a separate striking member 86 on the head 12 of the striking tool 10. This embodiment is particularly useful when the head 12 is made out of relatively lighter weight, but softer materials, such as titanium, titanium-based alloys or the like. In such a configuration, the striking member 86 can be made out of hardened steel or the like. Because the majority of the head 12 will be made out of the lighter weight material, the striking tool 10 having the hardened steel striking member 86 will weigh significantly less, depending on the material for head 12, than if the entire head 12 was made out of hardened steel. In this manner, the user of the striking tool 10 can have the advantages of the hardened steel striking face 20 without the added weight of the entire head 12 being made out of hardened steel. The striking member 86 can be utilized with the embodiments of the present invention that only utilize the connecting element 42 through the tubular body portion 44 of the handle 14, the embodiments of the present invention that only have the keyway 38 and key 40 and the embodiments that have both these attachment mechanisms 36 (i.e., keyway 38, key 40 and connecting element 42). In any such configuration, the passageway 46 in the body portion 48 of the head 12 extends entirely through the body portion 48 and the connecting element 42 has an elongated body 72 which is sufficiently long to extend through the tubular body portion 44 of the handle 14, through the body portion 48 of the head 12 and into an aperture 88 in the striking member 86, as best shown in FIGS. 15-17. When the striking member 86 is joined to the head 12, the outward face 90 of the striking portion 16 of the head 12 will be in tight abutting relation with the inward face 92 of the striking member 86, which faces 90/92 are shown in FIGS. 16-17, to functionally join these components together as one to form the head 12. As with the embodiments described above, the connecting element 42 and the various passageways 46/82 and aperture 88 can be correspondingly threaded such that the connecting element 42 is threaded into these components (or at least the striking member 86) to join together the head 12, handle 14 and striking member 86. Alternatively, various adhesives or other devices can be utilized or the shrink fit process can be employed to join the components together as one.

Figure 18:
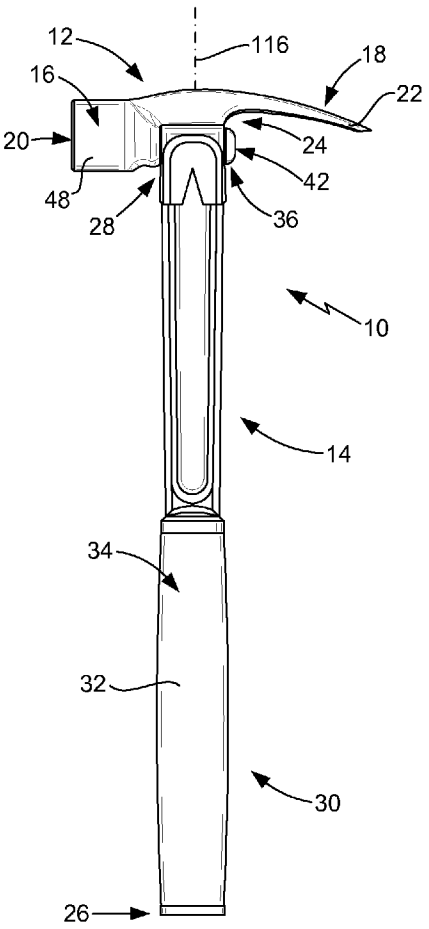
FIG. 18 is a side view of a striking tool configured according to a fourth embodiment of the present invention, with the striking tool shown having a nail puller on the side of the handle.
Figure 19:
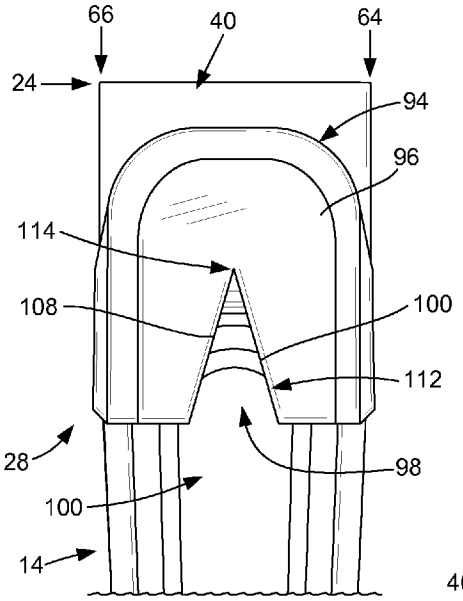
FIG. 19 is an enlarged side view of the upper section of the striking tool of FIG. 18.
Figure 20:
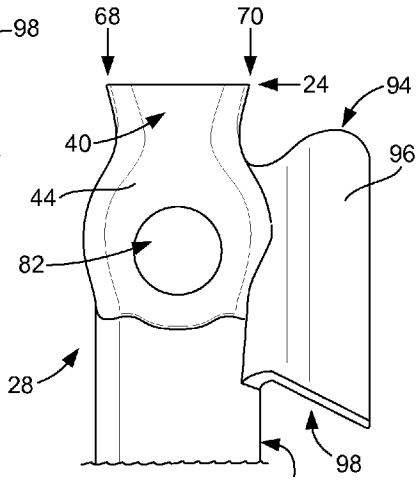
FIG. 20 is an enlarged end view of the upper section of the striking tool of FIG. 18.
Figure 21:
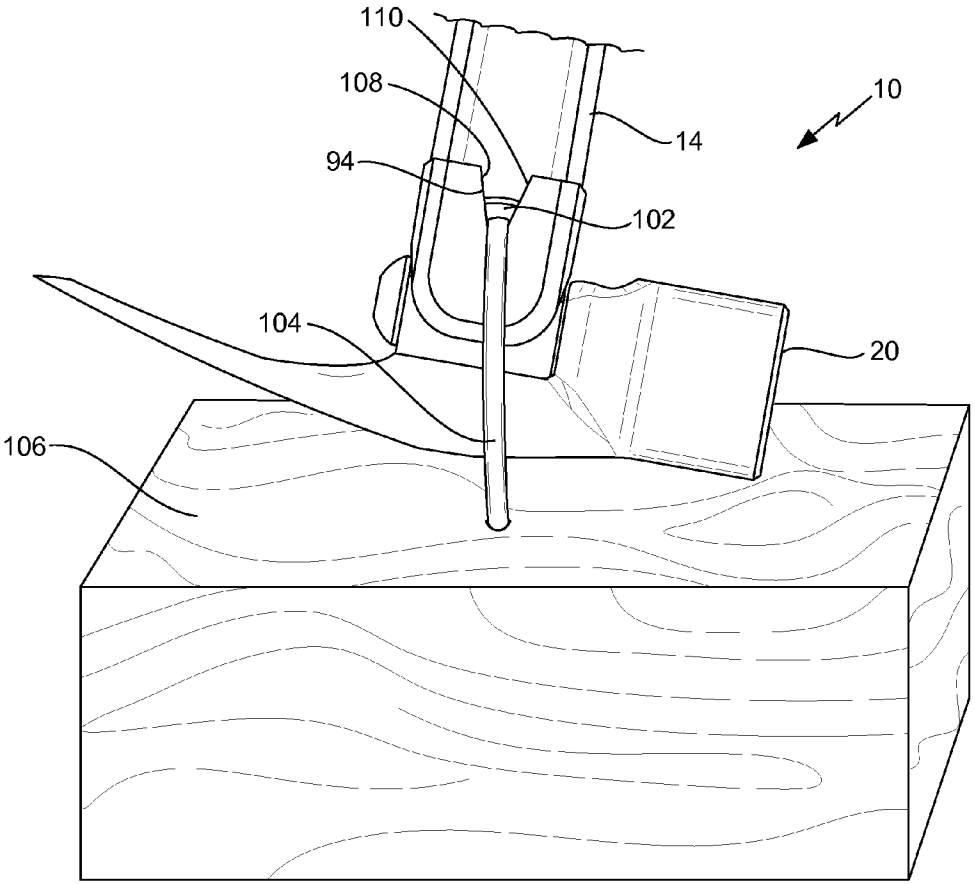
FIG. 21 is a side perspective view of the striking tool of FIG. 18 shown in use pull engaging a nail head to pull a nail from a piece of wood.

In another embodiment of the present invention, the striking tool 10 also includes a side nail puller 94 on the side of the handle 14, as shown in FIGS. 18-21 that is structured and arranged for the user to utilize to pull a nail from an object, such as a piece of wood. As with the side nail puller described in U.S. Pat. No. 6,923,432 to Martinez (the present inventor), the disclosure of which is incorporated herein as though fully set forth in the present disclosure, the side nail puller 94 of the present invention provides benefits with regard to pulling nails that are not available with the claw portion 18 of the striking tool 10. In the embodiment shown in the figures, the nail puller 94 is formed by casting or forging the body 96 of the nail puller 94 on one of the sides of the handle 14. The body 96 of the nail puller 94 is shaped and configured to define a chamber 98 between itself and the outer surface 100 of the handle 14, by the body 96 being in spaced apart relation with the outer surface 100, at the upper section 28 thereof. The chamber 98 is sized and configured to receive the nail head 102 of a nail 104 that is to be pulled from an object, such as a piece of wood 106, as shown in FIG. 21. The body 96 of the nail puller 94 has a pair of nail engagement edges 108 and 110 that are configured to define a v-shaped opening 112 in the body 96 of the nail puller 94. The nail engagement edges 108 of will engage and guide the nail 104 to the apex 114 of the v-shaped opening 112, as shown in FIG. 21. The apex 114 of the v-shaped opening 112 is located along the longitudinal axis 116 of the handle 14, as shown in FIG. 18. The apex 114 of the v-shaped opening 112 is configured so it will engage the nail 104 below the nail head 102 with the nail head 102 being disposed inside the chamber 98 formed by body 96. With the nail 104 engaged in the at the apex 114 of the v-shaped opening 112, the user will rotate the striking tool 10 to pull the nail 104 from the object 106, as shown in FIG. 21.

The nail puller 94 can be manufactured out of a variety of different materials and in a variety of different shapes. By utilizing the outer surface 100 of the handle 14 as part of the chamber 98 that receives the nail head 102, the striking tool 10 of the present invention eliminates the need to provide an opening inside the head 12 for the nail 104 (as described in U.S. Pat. No. 6,923,432 to Martinez). The nail puller 94 of the present invention can be manufactured by forming or casting the nail puller 94 as an integral unit with the handle 14 or it can be attached to handle 14 using materials and processes suitable for the materials that are utilized for the nail puller 94 and handle 14. In other embodiments, the nail puller 94 may be manufactured by machining, punching or other metal removal processes.

While there are shown and described herein specific forms of the invention, it will be readily apparent to those of ordinary skill in the art that the invention is not so limited, but instead is susceptible to various modifications and rearrangements in design and materials without departing from the spirit and scope of the invention. The embodiments described herein and shown in the figures were chosen in order to best explain the principles of the present invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A striking tool, comprising:

an elongated handle having an upper end and a lower end, said handle further comprising an upper section toward said upper end and a lower section toward said lower end;

a head having a striking portion, a body portion and an engagement face; and an attachment mechanism interconnecting said handle and said head, said attachment mechanism comprising at least one of a key at the upper end of said handle received in a slotted keyway on a lower side of said head and a connecting element disposed in a passageway transversely disposed through a tubular body portion of said handle to be received in a passageway of said body portion of said head, wherein said attachment mechanism comprises said key received in said keyway, said key having a first side and a second side, said keyway having a slot defining a first engagement side and a second engagement side, said first engagement side of said keyway being cooperatively configured with said first side of said key and said second engagement side of said keyway being cooperatively configured with said second side of said key so as to engage said key in said keyway, said keyway cooperatively configured with said engagement face so as to abut a first end of said key when said key is disposed in said keyway and said head is connected to said handle.

2. The striking tool of claim 1, wherein said striking portion of said head defines a striking face having a striking axis therethrough.

3. The striking tool of claim 1, further comprising a slot disposed in said key, said slot positioned between said first side and said second side of said key so as to extend downward from said upper end of said handle, said slot extending between said first end of said key and a second end of said key.

4. The striking tool of claim 1, wherein said attachment mechanism further comprises said connecting element, said connecting element having an elongated body sized and configured to extend through said passageway of said tubular body portion of said handle and engage said passageway in said body portion of said head.

5. The striking tool of claim 4, wherein said elongated body of said connecting element has a first end and a second end, said tubular body portion has a first end and a second end and said body of said head has an aperture disposed in an engaging face of said body portion, said first end of said connecting element sized and configured to pass through said passageway of said tubular body portion and said aperture in said engaging face to engage said passageway in said body portion of said head, said first end of said tubular body placed in abutting relationship with said engaging face of said body portion so as to secure said head to said handle.

6. The striking tool of claim 5, wherein said connecting element has a cap at said second end of said elongated body, said cap sized and configured to engage said second end of said tubular body portion when said connecting element is disposed through said passageway of said tubular body portion and said first end of said connecting element is fully received in said passageway of said body portion of said head.

7. The striking tool of claim 1 further comprising a striking member secured to said striking portion of said head.

8. The striking tool of claim 7, wherein said head is made out of titanium or titanium-based alloy and said striking member being harder than the titanium or titanium-based alloy of said head.

9. The striking tool of claim 7, wherein said attachment mechanism further comprises said connecting element, said striking member having an aperture that is sized and configured to receive and engage said connecting element, said connecting element extending through said passageway of said tubular body portion of said handle and through said passageway of said body portion of said head to be received in and engage said aperture of said striking member so as to secure said head to said handle and said striking member to said head.

10. The striking tool of claim 9, wherein said head is made out of titanium or titanium-based alloy and said striking member being harder than the titanium or titanium-based alloy of said head.

11. The striking tool of claim 1 further comprising a side nail puller attached to or integral with said upper section of said handle.

12. The striking tool of claim 11, wherein said side nail puller comprises a body in spaced apart relation with an outer surface of said handle so as to define a chamber between said body and said outer surface of said handle, said body having a pair of nail engaging edges that define a v-shaped opening opposite said outer surface of said handle, said v-shaped opening is sized and configured to receive a nail with a head of the nail in said chamber.

13. The striking tool of claim 12, wherein said v-shaped opening has an apex positioned substantially along a longitudinal axis of said handle.

14. The striking tool of claim 9, wherein said striking portion of said head has an outward face and said striking member has an inward face, said aperture of said striking member disposed in said inward face, said striking member being sized and configured to be positioned with said inward face thereof at said outward face of said striking portion, said passageway of said body portion of said head extending to said outward face of said striking portion, said connecting element sized and configured to extend through said outward face so as to engage said aperture of said striking member to secure said striking member to said outward face of said striking portion of said head.

15. A striking tool, comprising:

an elongated handle having an upper end and a lower end, said handle further comprising an upper section toward said upper end and a lower section toward said lower end;

a head having a striking portion and a body portion; and an attachment mechanism interconnecting said handle and said head, said attachment mechanism comprising a key at the upper end of said handle slidably received in a slotted keyway on a lower side of said head, said key having a first side and a second side, said keyway having a slot defining a first engagement side and a second engagement side, said first engagement side of said keyway being cooperatively configured with said first side of said key and said second engagement side of said keyway being cooperatively configured with said second side of said key so as to slidably engage said key in said keyway.

16. The striking tool of claim 15 further comprising a striking member secured to said striking portion of said head, said head being made out of titanium or titanium-based alloy and said striking member being harder than the titanium or titanium-based alloy of said head.

17. The striking tool of claim 15 further comprising a side nail puller attached to or integral with said upper section of said handle, said side nail puller comprising a body in spaced apart relation with an outer surface of said handle so as to define a chamber between said body and said outer surface of said handle, said body having a pair of nail engaging edges that define a v-shaped opening opposite said outer surface of said handle, said v-shaped opening being sized and configured to receive a nail with a head of the nail in said chamber.

18. The striking tool of claim 15 further comprising a slot disposed in said key, said slot positioned between said first side and said second side of said key so as to extend downward from said upper end of said handle, said slot extending between said first end of said key and a second end of said key.

19. A striking tool, comprising:

an elongated handle having an upper end and a lower end, said handle further comprising an upper section toward said upper end and a lower section toward said lower end;

a head having a striking portion and a body portion; and an attachment mechanism interconnecting said handle and said head, said attachment mechanism comprising a connecting element having an elongated body disposed in a passageway transversely disposed through a tubular body portion of said handle so as to be received in a passageway of said body portion of said head, said elongated body sized and configured to extend through said tubular body portion of said handle and engage said passageway in said body portion of said head.

20. The striking tool of claim 19 further comprising a striking member having an aperture that is sized and configured to receive and engage said connecting element, said connecting element extending through said passageway of said body portion of said head to be received in and engage said aperture of said striking member so as to secure said head to said handle and said striking member to said head.

21. The striking tool of claim 19 further comprising a side nail puller attached to or integral with said upper section of said handle, said side nail puller comprising a body in spaced apart relation with an outer surface of said handle so as to define a chamber between said body and said outer surface of said handle, said body having a pair of nail engaging edges that define a v-shaped opening opposite said outer surface of said handle, said v-shaped opening being sized and configured to receive a nail with a head of the nail in said chamber.

22. A striking tool, comprising:

an elongated handle having an upper end and a lower end, said handle further comprising an upper section toward said upper end and a lower section toward said lower end;

a head having a striking portion and a body portion;

a striking member secured to said striking portion of said head; and an attachment mechanism interconnecting said handle and said head, said attachment mechanism comprising at least one of a key at the upper end of said handle received in a slotted keyway on a lower side of said head and a connecting element disposed in a passageway transversely disposed through a tubular body portion of said handle to be received in a passageway of said body portion of said head, wherein said attachment mechanism comprises said connecting element and said striking member has an aperture that is sized and configured to receive and engage said connecting element, said connecting element extending through said passageway of said tubular body portion of said handle and through said passageway of said body portion of said head to be received in and engage said aperture of said striking member so as to secure said head to said handle and said striking member to said head.

23. The striking tool of claim 22, wherein said head is made out of titanium or titanium-based alloy and said striking member being harder than the titanium or titanium-based alloy of said head.

24. The striking tool of claim 22 further comprising a side nail puller attached to or integral with said upper section of said handle.

25. The striking tool of claim 24, wherein said side nail puller comprises a body in spaced apart relation with an outer surface of said handle so as to define a chamber between said body and said outer surface of said handle, said body having a pair of nail engaging edges that define a v-shaped opening opposite said outer surface of said handle, said v-shaped opening is sized and configured to receive a nail with a head of the nail in said chamber.

26. The striking tool of claim 25, wherein said v-shaped opening has an apex positioned substantially along a longitudinal axis of said handle.

27. The striking tool of claim 22, wherein said striking portion of said head has an outward face and said striking member has an inward face, said aperture of said striking member disposed in said inward face thereof, said striking member being sized and configured to be positioned with said inward face thereof at said outward face of said striking portion, said passageway of said body portion of said head extending to said outward face of said striking portion, said connecting element sized and configured to extend through said outward face so as to engage said aperture of said striking member to secure said striking member to said outward face of said striking portion of said head.

28. The striking tool of claim 22, wherein said attachment mechanism further comprises said key received in said keyway, said key having a first side and a second side, said keyway having a slot defining a first engagement side and a second engagement side, said first engagement side of said keyway being cooperatively configured with said first side of said key and said second engagement side of said keyway being cooperatively configured with said second side of said key so as to slidably engage said key in said keyway.

29. The striking tool of claim 28, wherein said head further comprises an engagement face cooperatively positioned with said keyway so as to abut a first end of said key when said key is disposed in said keyway and said head is connected to said handle.

30. The striking tool of claim 28 further comprising a slot disposed in said key, said slot positioned between said first side and said second side of said key so as to extend downward from said upper end of said handle, said slot extending between said first end of said key and a second end of said key.

31. The striking tool of claim 22, wherein said striking portion of said head defines a striking face having a striking axis therethrough.

32. The striking tool of claim 22, wherein said connecting element has an elongated body sized and configured to extend through said passageway of said tubular body portion of said handle and engage said passageway in said body portion of said head.

33. The striking tool of claim 32, wherein said elongated body of said connecting element has a first end and a second end, said tubular body portion has a first end and a second end and said body of said head has an aperture disposed in an engaging face of said body portion, said first end of said connecting element sized and configured to pass through said passageway of said tubular body portion and said aperture in said engaging face to engage said passageway in said body portion of said head, said first end of said tubular body placed in abutting relationship with said engaging face of said body portion so as to secure said head to said handle.

34. The striking tool of claim 33, wherein said connecting element has a cap at said second end of said elongated body, said cap sized and configured to engage said second end of said tubular body portion when said connecting element is disposed through said passageway of said tubular body portion and said first end of said connecting element is fully received in said passageway of said body portion of said head.

* * * * *